US009862084B2

(12) United States Patent
Hamilton

(10) Patent No.: US 9,862,084 B2
(45) Date of Patent: Jan. 9, 2018

(54) ACTUATION SYSTEM

(71) Applicant: GlobalForce IP Limited, Auckland OT (NZ)

(72) Inventor: Hamish William Hamilton, Oxford (NZ)

(73) Assignee: GlobalForce IP Limited, Auckland (NZ)

( * ) Notice: Subject to any disclaimer, the term of this patent is extended or adjusted under 35 U.S.C. 154(b) by 490 days.

(21) Appl. No.: 14/311,749

(22) Filed: Jun. 23, 2014

(65) Prior Publication Data

US 2015/0013534 A1 Jan. 15, 2015

Related U.S. Application Data

(63) Continuation of application No. 13/130,330, filed as application No. PCT/NZ2009/000305 on Dec. 24, 2009, now Pat. No. 8,770,457.

(30) Foreign Application Priority Data

Dec. 24, 2008 (NZ) ..... NZ573990
Dec. 24, 2008 (NZ) ..... NZ573991
Dec. 24, 2008 (NZ) ..... NZ573992

(51) Int. Cl.

| | |
|---|---|
| ***B25C 1/04*** | (2006.01) |
| ***B25F 5/00*** | (2006.01) |
| ***B25D 9/20*** | (2006.01) |
| ***F15B 15/02*** | (2006.01) |
| ***F15B 15/20*** | (2006.01) |

(52) U.S. Cl.

CPC ..... *B25F 5/008* (2013.01); *B25C 1/042* (2013.01); *B25D 9/20* (2013.01); *F15B 15/02* (2013.01); *F15B 15/20* (2013.01)

(58) Field of Classification Search

CPC . B25C 1/042; B25C 1/041; B25C 1/04; F15B 15/02; F15B 15/20

USPC ..... 227/10, 130

See application file for complete search history.

(56) References Cited

U.S. PATENT DOCUMENTS 2,854,953 A 10/1958 Osborne
3,542,273 A * 11/1970 Hedrick ..... B25C 1/041 227/130
3,572,572 A * 3/1971 Readyhough ..... B25C 1/041 227/130

(Continued)

OTHER PUBLICATIONS

WO 2010/082849 A1 (instant PCT application) with International Search Report, dated May 20, 2010.

(Continued)

*Primary Examiner* — Andrew M Tecco
(74) *Attorney, Agent, or Firm* — Frederick H. Gribbell

(57) ABSTRACT

A device includes an actuation system with a dose chamber including an inlet for high pressure fluid. A working chamber extends away from the dose chamber. An annular wall separates a portion of the working chamber from the dose chamber such that the dose chamber encompasses the portion of the working chamber. In use an item to be driven along the working chamber is at least partially within the surrounded portion of the working chamber with the item at one end of its travel in the working chamber. A valve mechanism selectively allows high pressure fluid from the dose chamber to flow into the piston chamber.

11 Claims, 5 Drawing Sheets

(56) References Cited

U.S. PATENT DOCUMENTS

| | | | | | |
|---|---|---|---|---|---|
| 3,615,049 | A | * | 10/1971 | Obergfell et al. | B25C 1/005 227/120 |
| 3,815,475 | A | * | 6/1974 | Howard | B25C 1/042 227/130 |
| 3,840,165 | A | | 10/1974 | Howard | |
| 4,040,554 | A | | 8/1977 | Haytayan | |
| RE29,527 | E | * | 1/1978 | Ramspeck | B25C 1/044 227/130 |
| 4,211,352 | A | | 7/1980 | Zilka | |
| 4,252,261 | A | | 2/1981 | Klaus | |
| 4,401,251 | A | | 8/1983 | Nikolich | |
| 4,549,344 | A | | 10/1985 | Nikolich | |
| 4,688,645 | A | | 8/1987 | Muller | |
| 4,821,683 | A | | 4/1989 | Veldman | |
| 5,020,712 | A | | 6/1991 | Monacelli | |
| 5,135,152 | A | | 8/1992 | Uno | |
| 5,191,861 | A | | 3/1993 | Kellerman | |
| 5,671,880 | A | | 9/1997 | Ronconi | |
| 5,782,395 | A | | 7/1998 | Sauer | |
| 5,829,660 | A | | 11/1998 | White | |
| 5,878,936 | A | | 3/1999 | Adachi | |
| 6,032,847 | A | | 3/2000 | Ehmig | |
| 6,116,489 | A | | 9/2000 | Branston | |
| 6,145,727 | A | | 11/2000 | Mukoyama | |
| 6,155,472 | A | | 12/2000 | Deziel | |
| 6,220,496 | B1 | | 4/2001 | Hirai | |
| 6,834,789 | B1 | | 12/2004 | Dion | |
| 6,845,896 | B2 | | 1/2005 | Kral | |
| 6,854,631 | B2 | | 2/2005 | Burke | |
| 7,128,030 | B2 | | 10/2006 | Gschwend | |
| 7,278,561 | B2 | | 10/2007 | Schnell | |
| 7,293,684 | B1 | * | 11/2007 | Wen | B25C 1/045 123/46 SC |
| 7,296,721 | B1 | | 11/2007 | Wen | |
| 7,325,710 | B1 | | 2/2008 | Wen | |
| 7,401,719 | B2 | | 7/2008 | Ou | |
| 7,637,406 | B2 | | 12/2009 | Deng et al. | |
| 7,677,426 | B2 | | 3/2010 | Tillinghast | |
| 8,770,457 | B2 | * | 7/2014 | Hamilton | B25C 1/042 227/10 |
| 2003/0173393 | A1 | | 9/2003 | Kral | |
| 2005/0189395 | A1 | | 9/2005 | Terrell | |
| 2005/0252944 | A1 | * | 11/2005 | Patrick | B25C 1/04 227/8 |

OTHER PUBLICATIONS

Written Opinion of the International Searching Authority, dated May 20, 2010.

* cited by examiner

ACTUATION SYSTEM

CROSS-REFERENCE TO RELATED APPLICATIONS

The present application is a continuation of application Ser. No. 13/130,330, filed May 20, 2011, under the title ACTUATION SYSTEM, which was a PCT National Stage application; and claims priority to PCT/NZ2009/000305, under the title "ACTUATION SYSTEM", filed International Stage on Dec. 24, 2009; and claims priority to patent applications: NZ573990, filed Dec. 24, 2008; NZ573991, filed Dec. 24, 2008; and NZ573992, filed Dec. 24, 2008.

BACKGROUND OF THE INVENTION

Field of the Invention

The present inventions relate to an actuation system for a high pressure fluid powered device. The invention has particular application to a high pressure impact device.

Description of the Prior Art

Pneumatic drive systems are used in a variety of applications, particularly with regard to tools. Traditionally, pneumatic tools have been designed to be connected to a source of compressed air, such as a stationary air compressor.

While air compressors provide an effectively unlimited supply of compressed air, they do have several disadvantages. In particular, the need to connect a tool to the air compressor via a hose limits the portability of the tool and also the positions into which it can be manoeuvred. Additionally, air compressors are generally expensive and outside the financial means of some users. Further, safety issues arise from having the hoses lying around the work place which may become caught on various objects or trip up persons within the space.

In an attempt to address these problems, several different systems have been developed.

One such system utilises a combustible gas, such as butane, to provide an explosion that drives the tool's operation. Such combustion systems have safety issues of their own given that the tool usually includes a storage device for combustible gas and a combustion source close to each other. The gas and gas cartridges tend to be expensive and only available from select suppliers. Further, the heat and impact of the explosions tend to be hard wearing on the tool causing them to require frequent maintenance. The electrical components are susceptible to failure if the tool is exposed to moisture such as rain. All of these factors add additional costs and an element of inconvenience to the user.

More recently, portable pressure sources have been developed by which a vessel containing a pressurised fluid such as carbon dioxide may be connected via a regulator to a tool traditionally powered by an air compressor. These systems allow the tools to be used in a more portable fashion without being restricted by the hosing requirements of conventional set ups.

However the available pneumatic tools are designed for a pneumatic set up where the supply of compressed air or gas is effectively unlimited. As such, the energy transfer is relatively inefficient, particularly in the drive mechanism.

In particular, the drive mechanisms of such tools have passages and chambers shaped such that excessive space is present—"dead volume" which requires filling during operation of the tool. This requires a larger volume of gas to be used in each operating cycle.

As well as requiring a larger volume of gas to fill the space, this dead volume disrupts the flow of the gas, reducing the efficiency of the energy transfer to the drive mechanism of the tool. As a result, a greater amount of gas is required in order to achieve the desired power output of the tool.

Therefore, using the portable pressurised fluid systems previously discussed generally results in the tool being able to be used only for an impractically low number of repetitions before replacement or replenishment of the fluid vessel is required.

Further, in situations where the fluid is stored in a liquid phase and vaporised to drive the tool, the low temperatures generated by the vaporisation of the fluid causes problems. The tools have a tendency to freeze and malfunction after a certain number of uses and exposure of the operating mechanism of the tool to the pressurised gas. A more efficient energy transfer mechanism would require a smaller volume of gas to be used per operating cycle. This would result in less cooling issues and extend the number of repetitions the tool could perform before freezing.

The noise created by each operation of the tool is also an issue, as it has the potential to cause hearing damage to the user and other people nearby. The noise also adds to noise pollution of the environment, which is at the very least an annoyance, particularly in a residential area. The noise created by the tool's operation and exhaust is related to the volume of gas used. Reducing the volume of gas required may reduce the noise generated by the tool.

It would therefore be an advantage for the drive mechanism of a pneumatic tool to be more efficient in the consumption of gas.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

DISCLOSURE OF INVENTION

According to a first aspect, the invention consists in a device including an actuation system comprising:

a dose chamber including an inlet for high pressure fluid;

a working chamber extending away from the dose chamber;

an annular wall separating a portion of the working chamber from the dose chamber such that the dose chamber encompasses the portion of the working chamber, in use an item to be driven along the working chamber being at least partially within the surrounded portion of the working chamber with the item at one end of its travel in the working chamber, a valve mechanism to selectively allow high pressure fluid from the dose chamber to flow into the piston chamber.

According to another aspect, the invention consists in a device including an actuation system comprising: a dose chamber including an inlet for high pressure fluid; a working chamber extending away from the dose chamber; an annular wall separating a portion of the working chamber from the dose chamber such that the dose chamber encompasses the portion of the working chamber, wherein the annular wall is an annular valve member movable between a sealed condition and an open condition where fluid in the dose chamber flows from the dose chamber to the working chamber, and in use an item to be driven along the working chamber being at least partially within the surrounded portion of the working chamber with the item at one end of its travel in the working chamber, and a valve mechanism to selectively allow high pressure fluid from the dose chamber to flow into the piston working chamber, and operable to move the valve member to the unsealed condition.

According to a further aspect, the annular wall is an annular valve member movable between a sealed condition and an open condition where fluid in the dose chamber flows from the dose chamber to the working chamber, and the valve mechanism operates to move the valve member to the unsealed condition.

According to a further aspect, an inlet flow path to the dose chamber is not closed when the valve member is open, but has much greater flow resistance than the outlet to the working chamber.

According to a further aspect, the device includes a dose valve hammer releasable from a first position to strike the valve member and unseat the valve member to the open condition.

According to a further aspect, the device includes a piston in the working chamber, a head portion of the piston extending into the surrounded portion of the working chamber with the piston at one end of its travel in the working chamber.

According to a further aspect, the piston includes a head portion extending toward the inlet of the working chamber;

the cross sectional area of the piston head portion gradually decreasing toward the inlet end of the working chamber, the inlet region of the piston chamber having a shape complementing the shape of the piston head portion.

In a second aspect, the invention consists in a device comprising:

a dose chamber including an inlet for high pressure fluid;

a working chamber having an inlet end;

a valve member with an annular sealing surface surrounding the inlet end of the working chamber, wherein with the valve member in a closed condition the sealing surface meets with an annular seat; and with the valve member in an open condition a gap is presented between the annular sealing surface and the seat as an outlet from the dose chamber to the working chamber; and a triggering mechanism including a hammer to unseat the valve member to the open condition.

According to a further aspect, the dose chamber encompasses a portion of the working chamber, the valve member dividing the dose chamber from the encompassed portion of the working chamber.

According to a further aspect, wherein the working chamber is a piston chamber, and the device includes a piston in the working chamber and wherein the piston includes a head portion extending toward the inlet of the working chamber;

the cross sectional area of the piston head portion gradually decreasing toward the inlet end of the piston chamber, the inlet region of the piston chamber having a shape complementing the shape of the piston head portion.

According to a further aspect, an inlet flow path to the dose chamber is not closed when the valve is open, but has much greater flow resistance than the outlet to the working chamber.

According to a further aspect, the sealing surface of the dose valve seats against a wall of the dose chamber.

According to a further aspect, a biasing mechanism such as a coil spring biases the valve to be normally sealed against the wall of the dose chamber.

According to a further aspect, the valve includes a spanning portion with an impact point central to the valve inlet, and the hammer is arranged to strike the spanning portion in use in order to unseat the valve.

According to a further aspect, the hammer is moveable between positions including a first position extending through a port into the working chamber to bear on the valve member, and a second position withdrawn from contacting the valve member, and the hammer seals with the port in the first position, but not in the second position.

According to a further aspect, the device is a nail gun.

According to a further aspect, the device includes an annex from the dose chamber, with a movable divider in the annex dividing the annex into a first portion and a second portion, and an adjustment mechanism allowing adjustment of the position of the movable divider such that movement of the divider expands one portion of the annex at the expense of the other.

According to a further aspect, the device includes a restricted fluid path between the first portion of the annex and the second portion of the annex.

According to a further aspect, the device includes a conduit having a first end connected to, or adapted to be connected to, a regulator, and a second end for supplying gas to the dose chamber, the conduit having an extended path including a substantial length adjacent the working chamber of the device.

In a third aspect, the invention consists in a pneumatic tool including an actuation system comprising:

a piston chamber having an inlet at one end, and a bore, with an inlet region adjacent the inlet having a smaller transverse cross sectional area than the bore, a piston within the piston chamber slidable in use of the tool along the bore from a position adjacent the inlet end;

the piston including a head portion extending toward the inlet of the piston chamber;

the cross sectional area of the piston head portion gradually decreasing toward the inlet end of the piston chamber, the inlet region of the piston chamber having a shape complementing the shape of the piston head portion.

According to a further aspect, the transverse cross-sections areas of the inlet end of the piston chamber, the piston head and the piston chamber bore are circular in shape.

According to a further aspect, the transverse cross section of the piston head transitions linearly between the point closest to the inlet and the point where the cross-section of the piston head closest to the piston chamber bore is substantially the same as the piston chamber bore.

According to a further aspect, the piston head is shaped in the form of a truncated cone.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The term "comprising" is used in the specification and claims, means "consisting at least in part of". When interpreting a statement in this specification and claims that includes "comprising", features other than that or those prefaced by the term may also be present. Related terms such as "comprise" and "comprises" are to be interpreted in the same manner.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1A:
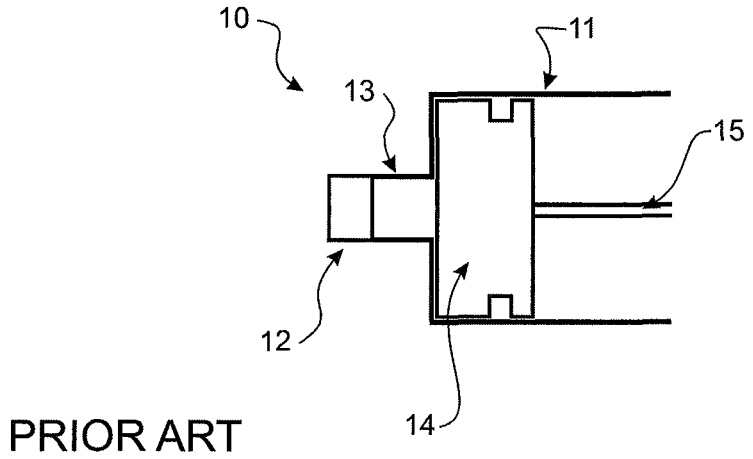
FIGS. 1*a*, 1*b* illustrate a prior art actuation system.
Figure 1B:
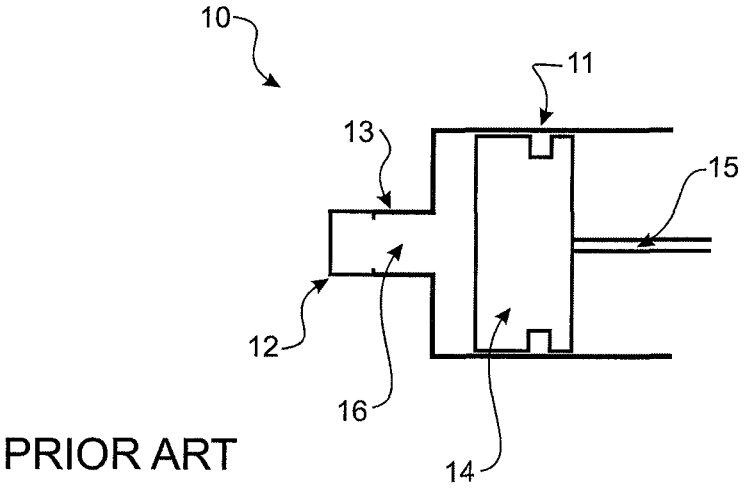

FIGS. 1*a* and 1*b* show a prior art actuation system (generally indicated by arrow 10) for use in a typical nail gun (not illustrated).

The prior art actuation system (10) includes a piston chamber (11).

The piston chamber (11) is connected to a valve (12). The valve (12) is connected to a high pressure source (not illustrated).

The valve (12) controls the flow of fluid from the high pressure source into the piston chamber (11) through an opening (13).

The piston chamber (11) contains a piston head (14) connected to a shaft (15).

The cross-sectional area of the piston head (14) remains substantially the same along its length.

The cross-sectional area of the piston chamber (11) is substantially greater than that of the opening (13).

FIG. 1*a* shows the prior art actuation system (10) at the beginning of an operating cycle, with the piston head (14) hard against the piston chamber (11) next to the opening (13). The valve (12) is closed, preventing the flow of fluid through to the piston chamber (11).

FIG. 1*b* shows the prior art actuation system (10) after the valve (12) has been opened.

On opening the valve (12), a dead volume (16) is created between the valve (12) and the piston head (14).

Before pressurised fluid from the high pressure source can actuate the piston head (14), this dead volume (16) must be filled. This requires the supply of fluid which is essentially wasted.

Having filled the dead volume (16), the pressurised fluid acts against the piston head (14) which with its associated shaft (15) is moved along the piston chamber (11).

As the dead volume (16) is being filled, the flow of gas becomes disrupted and circulates through the dead volume (16), rather than directly against the piston head (14).

Even once the dead volume (16) has been filled and the piston chamber (11) is pressurised, this disruption in the flow causes an inefficient transfer of energy from the fluid to the piston head (14).

The flow of fluid into the piston chamber (11) is further disrupted as the piston head (14) is unseated and creates a sharp transition in the cross-sectional area the fluid may flow through, from the opening (13) to the piston chamber (11). This transition disrupts the flow of fluid as it fans out through the opening (13), preventing direct application of the flow to the piston head (14).

Figure 2A:
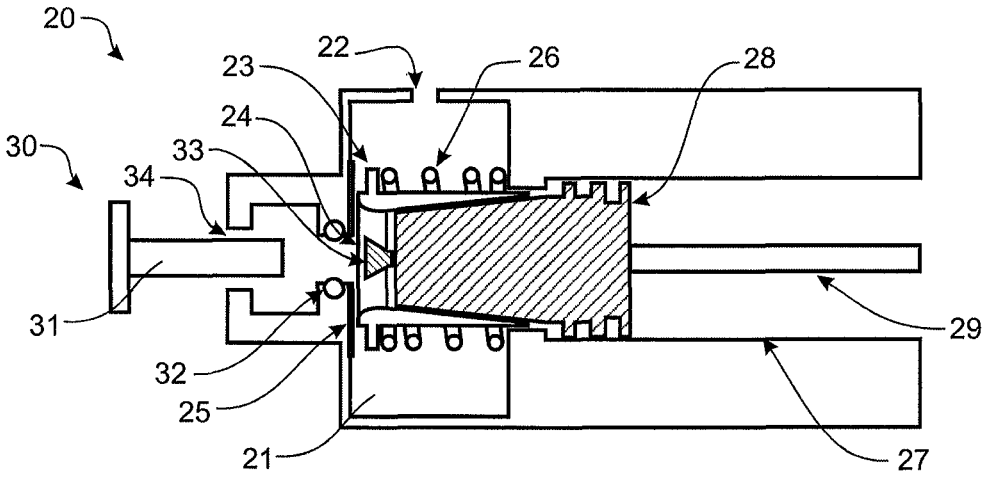
FIGS. 2*a*, 2*b*, 2*c* illustrate a cross sectional view of the present invention according to a preferred embodiment.
Figure 2B:
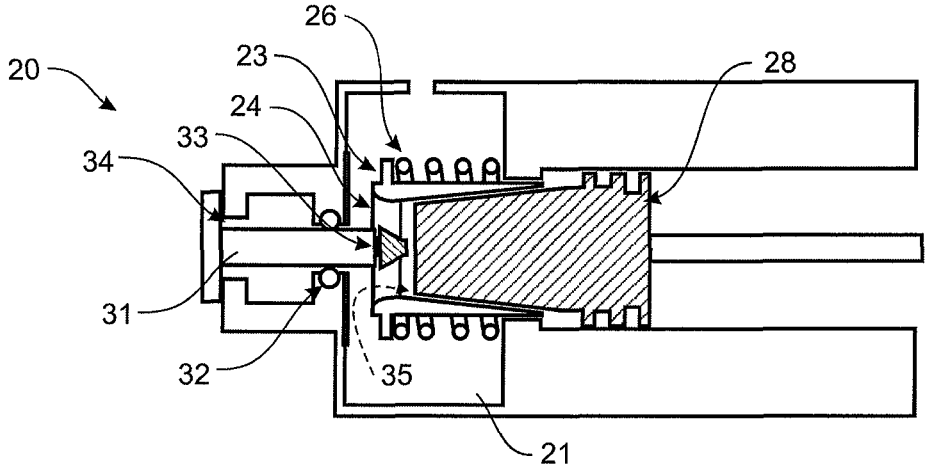
Figure 2C:
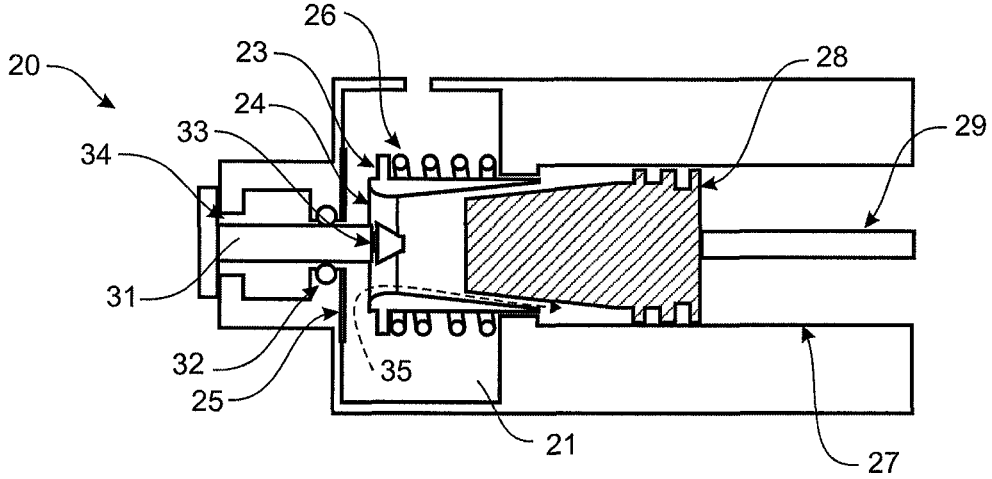

FIGS. 2*a*, 2*b* and 2*c* illustrate the actuation system (generally indicated by arrow 20) of a motion transfer device (not illustrated) in accordance with a preferred embodiment of the present invention. In particular, the actuation system (20) is to be used in a nail gun (for example, in the manner illustrated in FIG. 3).

The actuation system (20) includes a dose chamber (21).

The dose chamber (21) includes a port (22) configured to connect to a high pressure fluid source (not illustrated). The high pressure fluid source provides gaseous carbon dioxide to the actuation system (20). It should be appreciated that the high pressure fluid source may provide any number of pressurised fluids to the actuation system (20), and that reference to carbon dioxide is by example only.

The actuation system (20) includes a valve (23).

The valve (23) includes a valve inlet (24).

The valve (23) is located substantially within the outer boundary of the dose chamber (21). The valve inlet (24) is sealed against a wall of the dose chamber (21). This prevents the flow of gas from the dose chamber (21) through the valve (23).

The body of the valve (23) defines an inner wall of the dose chamber (21). The does chamber (21) is annular in shape, surrounding the valve (23).

A resilient seal (25) is provided on the wall of the dose chamber (21) to assist the valve to make an effective seal under pressure. The seal may be formed from a rubber or other elastomer material.

The valve (23) is biased by a spring (26) to be normally sealed. The spring acts between a wall of the does chamber (21) and a flange on the valve (23). The spring is located around the body of valve (23).

The valve opening (24) connects the dose chamber (21) to a piston chamber (27). In the preferred embodiment the piston chamber (27) includes a region in the interior of the body of valve (23).

The region of the piston chamber that is within valve (23) is configured to receive a piston head (28). The cross-sectional area of the piston head (28) closest to the valve inlet (24) is substantially the same as the cross sectional area of the valve inlet (24).

The piston chamber includes a bore (49). The piston head is slidable along the length of the bore and generally seals against the wall of the bore. The bore may be cylindrical, but could also have other than circular cross section.

At the end closest to the valve (23), the bore is slightly larger than the outside diameter of the body of the valve. When the valve depresses against the spring (26) the forward end (45) of valve (23) may displace slightly into the bore.

The cross-sectional area of the piston head (28) closest to the piston chamber bore is substantially the same as that of the piston chamber bore (49). Preferably the piston head tapers gradually from the cross section of the valve inlet (23) to the cross section of the piston chamber bore. As a result, the piston head is effectively conical.

In the nail gun, the piston head (28) is connected to a driver blade (29). The driver blade (29) is substantially contained within the piston chamber (27) at one end of the piston travel, but extends from the chamber (27) when the piston is pushed down by the high pressure gases. The driver blade is configured to impact a nail (not shown) in order to drive the nail into an intended target (not shown).

The actuation system (20) includes a displacement member (30). The displacement member (30) includes dose valve hammer (31). The dose valve hammer (31) is shaped and sized such that it forms a seal inside an O-ring (32). The displacement member (30) is configured to be actuated by a triggering mechanism (not shown) to initiate the operating cycle of the actuation system (20).

The dose valve hammer (31) is configured to impact an impact point (33) on the valve (23) in order to unseat the valve (23). The passage around the dose valve hammer (31) forms an exhaust (34) for the gas after actuating the piston head (28).

FIG. 2*a* illustrates the actuation system (20) at the beginning of an operating cycle.

The valve (23) is seated against the seal (25), preventing the flow of gas from the dose chamber (21) through the valve inlet (24).

FIG. 2*b* illustrates the actuation system (20) where the valve (23) has been unseated, in the moment before the high pressure gas begins to move piston head (28).

The dose valve hammer (31) has been actuated to act against the impact point (33), overcoming the spring (26) to unseat the valve (23). A flow pathway (35) is created, and gas begins to flow from the dose chamber (21) through the valve inlet (24) to act against the piston head (28) on either side of the impact point (33).

Immediately prior to contacting the impact point (33), the hammer (31) closes the port (32) in order to block the exhaust (34), and prevent gas from exiting before acting against the piston head (28).

At the point illustrated by FIG. 2*c*, the piston head (28) has been driven away from the valve inlet (24) in the direction of the piston chamber (27) by the flow of high pressure gas from the dose chamber.

The space between the piston head (28) and valve (23) extends the flow pathway (35) for the gas to flow from the dose chamber (21) and act against a greater surface area of the piston head (28). As the piston head (28) is driven further along the piston chamber (27), the cross-sectional area of the flow pathway (35) increases, allowing a greater flow of gas through to act against the piston head (28).

This increasing flow of gas ensures that energy is transferred efficiently, and consistent acceleration of the piston head (28) is achieved.

Eventually the piston head (28) has moved fully into the bore (49). At this point the cross-sectional area of the flow pathway (35) is constant. The piston head (28) continues down the bore (49) and drives the blade (29) to strike the nail and embed the nail in its intended target. Sometime after opening, the valve (23) is driven by the spring (26) to be seated against the seal (25), closing the flow pathway (35). This can either result from withdrawal of the dose valve hammer, but preferably the force from spring (26) is sufficient to push back the hammer.

Upon further withdrawal, the hammer is removed from port (32) unblocking the exhaust (34). The gas contained within the piston chamber (27) and valve (23) is thereby released from the actuation system (20).

The piston head (28) and blade (29) are then returned to the position illustrated by FIG. 2*a* in preparation for the next operating cycle.

Figure 3:
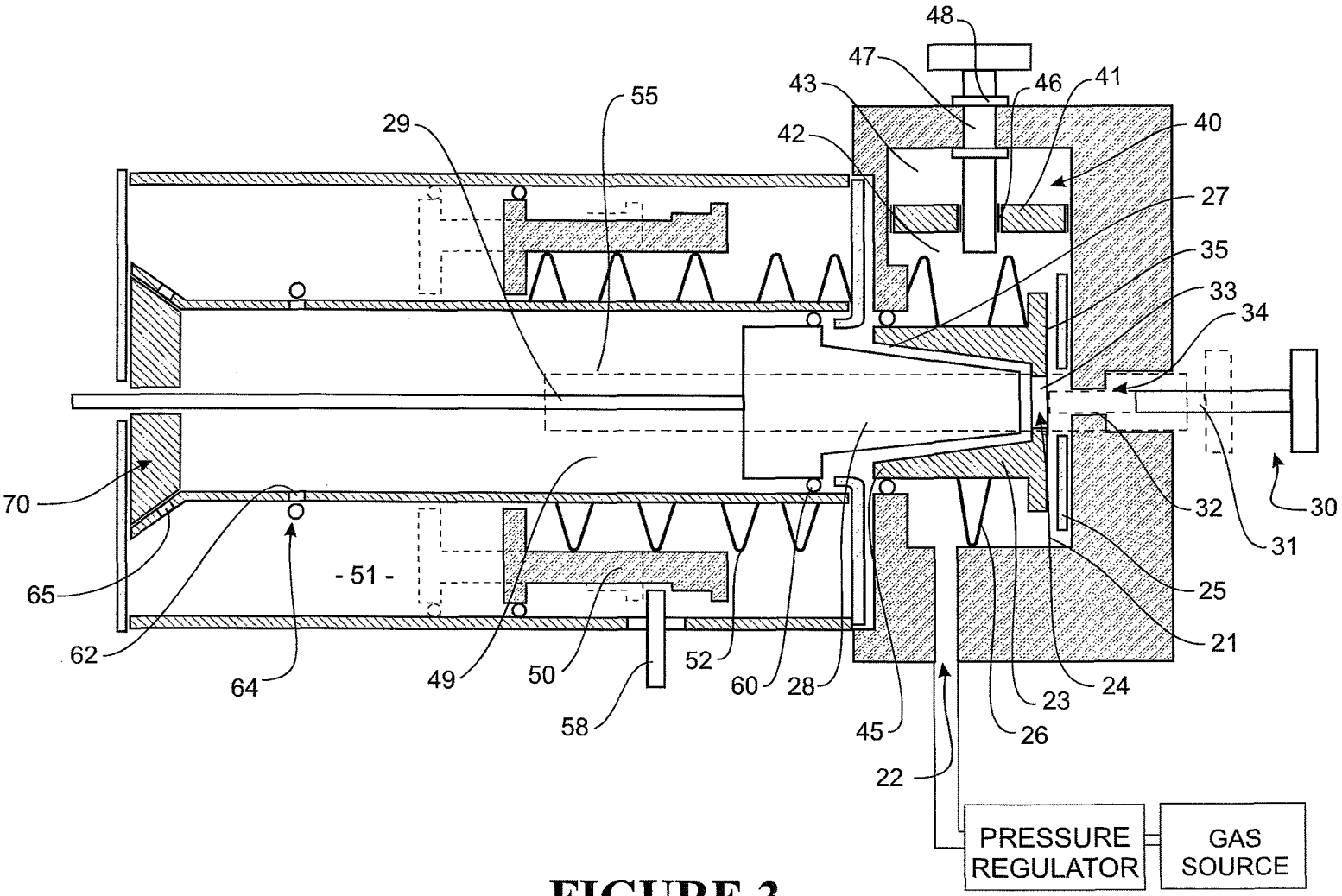
FIG. 3 illustrates a nail gun incorporating the present invention.

FIG. 3 is useful to illustrate how this actuation mechanism works within a preferred arrangement of the nail gun. However the mechanism is applicable to other nail gun embodiments and to tools generally that include a drive piston.

In the nail gun of FIG. 3 gas is supplied from a regulator through CO2 inlet (22). The chamber (21) is maintained charged with gas from the regulator between actuations. No additional valve is required in the inlet path from the regulator to the chamber.

According to a preferred form the fluid path from the regulator to the inlet (22) includes an extended conduit, with a large part of the path of the conduit being adjacent the actuation mechanism of the gun. In particular adjacent the barrel of the gun, outside and around the piston chamber. This arrangement will be described in more detail below with reference to FIGS. 4 to 7.

The dose chamber (21) is essentially annular around the body of valve (23).

Dose chamber (21) may include an annex (40) providing additional volume. The annex (40) may include an adjustable divider (41) dividing the annex into a primary space (42) and a secondary space (43). Movement of the divider (41) increases the size of one of the spaces at the expense of the other. This preferred arrangement is described below with reference to FIG. 7.

One or more restricted flow pathways are provided between the primary space (42) and the secondary space (43). The total flow pathway between the two spaces is much more restricted than the outlet of the dose chamber.

To pressurise the primary space (42), the outlet is sealed by valve (23) in order to prevent the flow of fluid from the chamber (21).

Fluid flows into the primary space (42) from an external source (not shown) through inlet (22). Pressure builds in the space (42) until it equalises with the pressure of the source.

While the primary space (42) is pressurised, it may be desirable to adjust the volume of the primary space (42). Flow pathways (46) equalises the pressure between the primary chamber (42) and secondary chamber (43) such that axial translation of the divider (41) along the annex (40) is easy.

Although the dividing flow pathways (46) allows the pressure in the primary space (42) and secondary space (43) to equalise, the flow rate is significantly lower than that which may be achieved through the valve (23). Accordingly, when a rapid cycle of releasing the fluid through valve (23) and then closing valve (23) is repeated, the flow of gas across the divider is restricted and there is insufficient time for the pressure across the divider to equalise. Accordingly, adjusting the location of the divider (41) adjusts the volume of the high pressure charge for the tool as only a small amount of the high pressure fluid in the secondary chamber is able to escape while the valve (23) is open.

An adjustment rod (47) passes through the centre of the divider (41). At the point of connection between the adjustment rod (47) and the divider (41) are provided corresponding helical threads (46).

The adjustment rod (47) does not move axially within the chamber (40). The rod (47) may include a collar or lugs (148 engaging with the end wall of the pressure chamber (40) in order to maintain the axial position of the rod within the chamber (40).

The divider (41) is translated within the chamber (40) by the rotation of adjustment rod (47) via an adjustment knob.

The gun includes a triggering and reset mechanism. Triggering is driven by releasing a compressed spring to drive the dose valve hammer onto the dose valve. Reset, including returning the triggering spring to the compressed condition, is driven by the last available expansion of the charge of gas.

The triggering and reset mechanism includes a reset piston (50) sliding in a bore (51) adjacent the piston chamber bore (49). The reset bore and the piston chamber bore are connected by fluid ports at a first position adjacent the forward end and a second position spaced from the forward end. The transfer ports (62) at the second position are covered by a valve member so that gases can only flow from the piston chamber to the bore (51). In the preferred form the bore (51) is an annular chamber surrounding the piston chamber. In this arrangement the reset piston (50) is an annular ring, and the valve member for covering the second ports may be an elastomeric o-ring (64).

A spring (52) is located between the reset piston and the rear end wall (53) of the bore (51). A trigger arrangement includes a tang (58) that extends into the bore (51) and engages the reset piston (50) in a cocked position. In this position the spring (52) is compressed between the reset piston (50) and the wall (53). Depressing the trigger moves the tang to release the reset piston (50). The spring (52) accelerates the piston (50) in a forward direction down bore (51).

A connecting member (55) (which may be in the form of a rod) extends rearward from the reset piston (50). The connecting member extends through a port in the end wall (53) of the bore (51) and connects to dose valve hammer (31).

When the reset piston (50) accelerates forward along the bore (51) the connected dose valve hammer (31) accelerates toward the impact point (33) of valve (23). The hammer (31) passes opening (32) and impacts the valve (23). Upon impact, the momentum of the hammer (31) depresses valve (23), releasing high pressure gas from the dose chamber (21) into the piston chamber. This high pressure gas drives the piston head forward along the piston chamber.

The valve spring (26) returns the valve to the closed position, at the same time pushing back the dose valve hammer (31) until it just protrudes through port (32). The opening time of the dose valve depends on the stiffness of and compression or extension of springs (26) and (52), the mass of the moving parts and the exposed surfaces subjected to the gas pressures. Adjustment of these factors can provide for adjustment of the amount of the time the valve remains open.

Once the outer seal (60) of the piston head (28) passes transfer ports (62) the transfer ports are exposed to the driving gases at a reduced, but still elevated, pressure. The pressure of these gases opens ring valve (64) and the gases flow into the bore (51). These gases push against the reset piston (50), pushing it rearward, compressing the spring (52). As the reset piston moves to the rear the connected dose valve hammer moves in a rearward direction to open an exhaust opening (68) from the piston chamber through port (32) and exhaust passage (34) through port (32) and exhaust passage (34).

Once the reset piston has returned sufficiently far to the rear it is engaged by the tang (58) of the trigger.

Further expansion of the gases in the bore (51) forces gas through a barrel vent (65) from the outer bore (51) to the piston chamber in front of the piston (28). This gas pushes the piston head to the rear of the piston chamber, expelling excess gases behind the piston head through the exhaust opening (34).

FIG. 3 shows the reset piston and dose valve hammer in the cocked position ready for firing. The released position of the hammer and reset piston, where the hammer holds the dose valve open, is shown in broken lines. The connecting member 55 is also shown in broken lines as it is hidden from view. The dose valve is shown in the open position, displaced away from seat (25). A resilient seal and buffer (70) is provided at the forward end of the gun. This buffer absorbs any impact of the piston into the end of the piston chamber, and seals against the driver blade (29) so that the residual gas pressure can push the piston back to the rear end of the piston chamber before dissipating.

If the nail gun fails to reset properly, for example due to inadequate gas pressure against the reset piston, the system can be recocked by pulling back the dose valve hammer. This has the effect of also puffing back the reset piston until it is locked by the tang. Preferably a cocking lever is provided on the rear of the housing. The cocking lever includes a pivot and a handle portion.

The dose valve hammer is engaged by the lever midway between the pivot and the handle portion, providing the user additional leverage in recocking.

Reference to a motion transfer device should be understood to mean any device whereby the movement of at least part of the device is transmitted to another object in order to perform a particular operation. It is envisaged that the motion transfer device may be in the form of a pneumatic tool. As particularly described and illustrated, the motion transfer device may be a nail gun.

It should be understood that this is not intended to be limiting, and that the present invention may be implemented in any situation where an actuation system is driven by a charge of pressurised fluid. For example, the motion transfer device may be a hammer drill, jackhammer or similar impact tool.

Reference to an actuation system should be understood to mean any mechanism by which energy is converted into motion. In a preferred embodiment the piston is the hammer or blade of a nail gun, and the actuation system converts the energy supplied by the high pressure source to linear motion, driving the piston to strike a nail and embed the nail in an intended target.

Alternatively, the motion transfer device may be a pneumatic gun, such as a paintball gun. The actuation system may be configured to drive the projectile by the flow of pressurised fluid itself.

Alternatively, the actuation system may be configured to assist in the priming of the firing mechanism—rather than driving the projectile itself.

Reference to fluid should be understood to mean any substance that is capable of flowing and is compressible. In a preferred embodiment the fluid is a gas, however this should not be seen as restricting.

In a preferred embodiment the high pressure fluid source provides a source of gaseous carbon dioxide. Carbon dioxide has numerous properties which make it useful for application in properly designed pneumatic applications. Carbon dioxide may be highly pressurised in order to store a high quantity in a small volume, and this high pressure allows for a high power output of the pneumatic tool as this can provide the power desired to operate the pneumatic tool.

Further, carbon dioxide is a relatively inexpensive gas to use.

One skilled in the art should appreciate that this is not intended to be limiting, and that the present invention may be implemented using any number of pressurised fluids.

It is envisaged that the high pressure fluid source supplies an inert gas such as nitrogen, argon, or helium in order to increase the safety factor of using the gun by eliminating the danger of combustion in the device.

The high pressure fluid source may also be pressurised air, for example supplied from a container of from an air compressor, as commonly used with pneumatic tools. The increased efficiencies of the present invention over the prior art would allow the use of a smaller compressor and lighter air hoses while maintaining the same level of performance. As a result the initial purchase and running costs to the user may be reduced, the compressor may be easier to transport, the tool with attached hose may be easier to manipulate, and noise of the system may be greatly reduced.

The high pressure fluid source may be configured to store liquid fluids which are converted to a gaseous phase before reaching the dose chamber.

Reference to a port should be understood to mean any way by which fluid may be introduced to the dose chamber from the high pressure source.

Reference to a dose chamber should be understood to refer to a space whereby a set quantity of fluid may be stored before being released to enter the piston chamber. It is envisaged that the volume of the dose chamber corresponds to the volume of fluid required to actuate the motion transfer device in one operating cycle.

It is envisaged that the dose chamber may include a mechanism which permits the volume of the dose chamber to be adjusted. Where the volume is reduced, the output power is reduced and vice versa. In the example of a nail gun, this allows the ready adjustment of the power to account for use of the nail gun with materials of different density and nails of different length.

As well as increasing the range of applications the nail gun may be used in, the power may be optimised for a particular use in order to minimise the consumption of pressurised fluid per repetition. This enables a greater number of repetitions of the nail gun to be achieved, reducing costs and increasing convenience to the user.

Further, it is envisaged that the mechanism should be capable of adjusting the volume while the dose chamber is pressurised.

Where the fluid is of a low temperature, reducing the volume of the dose chamber will lessen the freezing effect of the stored fluid—which can cause the motion transfer device to malfunction. This inherently allows the motion transfer device to be used for a greater number of repetitions. Further, where the fluid is carbon dioxide this will reduce the risk of dry ice forming in the exhaust.

In a preferred embodiment the actuation system includes a valve to release the pressurised fluid from the dose chamber, creating a flow of fluid to act against the piston head and enter the piston chamber.

Preferably the valve is located substantially within the dose chamber.

In a preferred embodiment the valve includes a valve inlet. Reference to a valve inlet should be understood to mean any point at which fluid enters the valve.

It is envisaged that the valve may be positioned such that the valve inlet is sealed against a wall of the dose chamber.

Preferably a biasing mechanism such as a coil spring biases the valve to be normally sealed against the wall of the dose chamber. Positioning of material such as rubber on the wall or valve may assist in forming the seal.

In a preferred embodiment the actuation system includes a trigger mechanism for unseating the valve and creating a flow pathway between the dose chamber and the valve inlet.

It should be appreciated that this is not intended to be limiting, and the valve may be any valve known to one skilled in the art such that the valve is located substantially within the dose chamber. For example the valve may be a needle valve or solenoid valve.

The preferred trigger mechanism will include a displacement member (or dose valve hammer) for striking against the impact point central to the valve inlet in order to overcome the biasing mechanism and unseat the valve. It should be appreciated that this is not intended to be limiting, and that the impact point may be at any point on the valve.

It is also envisaged that the trigger mechanism will be configured to provide an exhaust for the fluid after actuating the actuating mechanism.

In operation, the trigger mechanism is activated by a user, with a striking rod of the displacement member striking the valve's impact point—causing the valve to be unseated from the wall of the dose chamber.

It is envisaged that the exhaust pathway may include a port through which the striking rod passes to strike the valve. The striking rod is configured to seal the port in order to block the exhaust while the valve is unseated. Utilising the displacement member to also provide the functionality of controlling the exhaust reduces the number of parts used in the motion transfer device—reducing manufacturing and assembly costs, and reducing the overall weight.

The port may include an O-ring seal to seal against the exterior of the striking rod.

It should be appreciated that the exhaust may be blocked in any number of ways, and reference to the striking rod sealing against the O-ring within the exhaust should not be seen as limiting. For example a separate valve may be included for the purposes of opening and closing the exhaust.

Because the valve is positioned within the dose chamber, the flow pathways between the dose chamber and valve inlet created by unseating the valve are very short. This allows for a rapid release of pressurised fluid, ensuring the efficient transfer of energy from the fluid to the actuation system.

Returning to the preferred embodiment of the present invention, because the piston head is positioned within the boundary of the dose chamber the dead volume between the dose chamber and the face of the piston head is minimised.

Reference to dead volume should be understood to mean the space which must be filled by the charge of pressurised fluid in the dose chamber during an operating cycle of the motion transfer device, before the fluid acts on the piston.

In the preferred embodiment, the dead volume is reduced to only exist between the point of sealing on the valve and the face of the piston head. Dead volume commonly exists in pneumatic tools configured to be used with an air compressor, as it is not typically a major design consideration where an effectively unlimited supply of fluid is available.

The smaller dead volume results in a smaller volume of fluid being required per operating cycle of the actuation system. This has numerous advantages to it, including increasing the number of repetitions which may be achieved from a limited volume high pressure fluid source. Other benefits are as previously discussed, such as lowering the freezing effect of the fluid where this is applicable.

Once the flow of gas has actuated the piston head and associated piston to operate the motion transfer device for one cycle, the displacement member is removed from the impact point and the biasing mechanism seals the valve again.

At this point the exhaust is open to the valve, and the used pressurised fluid is removed from the piston chamber, through the body of the valve and into the exhaust.

The lower volume of fluid required per operating cycle also has a run on effect in the considerations for expelling the fluid during exhaust of the actuation system. Where the pressurised fluid is carbon dioxide, smaller amounts of dry ice will be produced during the exhaust—lessening the freezing effect and possible safety issues created by the production and expulsion of this dry ice.

The cross sectional area of the valve inlet is substantially smaller than that of the piston chamber. Generally, the transition in the inlet's cross-sectional area from small to large improves the gas flow path as the piston begins to move and thereby increases efficiency.

In a preferred embodiment, the cross-section of the piston head closest to the valve inlet is substantially the same as the valve inlet, and the cross-section of the piston head closest to the piston chamber bore is substantially the same as the piston chamber bore. The cross-sectional area of the valve inlet is smaller than the cross-sectional area of the piston chamber bore.

As well as requiring excess fluid, filling the dead volume also causes a disruption in the flow of air, resulting in an inefficient transfer of energy.

Preferably the cross-sections (transverse to the axis of piston movement) of the valve inlet, piston head and corresponding piston chamber are circular in shape. This is not intended to be limiting, and the cross sectional area may be any shape such that the piston head and transition section of the valve between the valve inlet and piston chamber fit complementary to each other. It is envisaged that the size of the cross section area of the piston head will transition linearly between the point closest to the valve inlet and the point where the cross-sectional area of the piston head closest to the piston chamber is substantially the same as the piston chamber bore. Where the cross sectional area is circular, this will result in the piston head and inner surface of the valve being shaped in the form of a cone.

This should not be seen as limiting, and it should be appreciated that the transition may result in effectively any shape, such as a dome or a pyramid.

In operation, the piston head is driven away from the valve inlet by the force applied by the pressurised fluid. In doing so, the area around the piston head continually increases—creating a larger pathway for the pressurised fluid to flow around the head.

This allows for a continual acceleration of the fluid flow until the piston head is fully contained in the piston chamber, and the cross sectional area available for the fluid to flow through becomes constant.

Conventional piston arrangements have a period of delay where the dead volume is filled. During this delay the flow of fluid is disrupted and does not transfer energy to the piston, resulting in a lower efficiency of the system.

The present invention allows for the continual transfer of energy from the fluid to the actuation system, increasing efficiency. Because of this, the operating pressure of the motion transfer device may be kept to a safe level while still achieving the desired power output. Where the fluid is a gas such as carbon dioxide, the lower pressure aids in ensuring the vaporisation of the gas—as the boiling point is lowered accordingly and may be more easily maintained.

This efficiency also allows a smaller volume of gas to be used per operating cycle, increasing the number of repetitions which may be achieved and lessening the freezing effect of each repetition on the motion transfer device.

The present invention offers a number of advantages over the prior art:

- Due to positioning of the piston head and subsequent reduction of dead volume, a smaller volume of pressurised fluid may be used per operating cycle. This allows a greater number of repetitions to be obtained from the high pressure fluid source, decreasing the costs associated with replenishing the source and increasing the convenience of using the motion transfer device.
- Shaping of the piston allows an acceleration of the pressurised fluid into the piston chamber, increasing energy transfer efficiency and reducing the pressure required to obtain sufficient power output. This increases the reliability of the motion transfer device and reduces the amount of gas required, reducing costs associated with replenishing the source.
- Due to the lower operating pressure and volume of gas required by the actuation system, the noise of the motion transfer device's operation is greatly reduced. This decreases the noise pollution created by the device and increases its usability.
- The smaller amount of pressurised fluid required per repetition reduces damage caused by freezing of the device, and allows a greater number of repetitions to be safely achieved.
- The smaller volume of pressurised fluid requiring expulsion during the exhaust of the actuation system reduces the exhaust requirements and potential safety hazards associated with this process. In particular, where the pressurised fluid is carbon dioxide the risk of dry ice forming in the exhaust is reduced.
- The opening area of the valve is large relative to the volume of the dose chamber, and the valve area opens rapidly. Accordingly a full charge of high pressure gas exits the dose chamber very quickly and the valve can return closed very soon after opening. This allows the mechanism to operate effectively without a separate inlet valve.

As mentioned above, the preferred embodiment of a nail gun includes a vaporisation system where the inlet path includes a substantial path length adjacent the drive mechanism.

Figure 4:
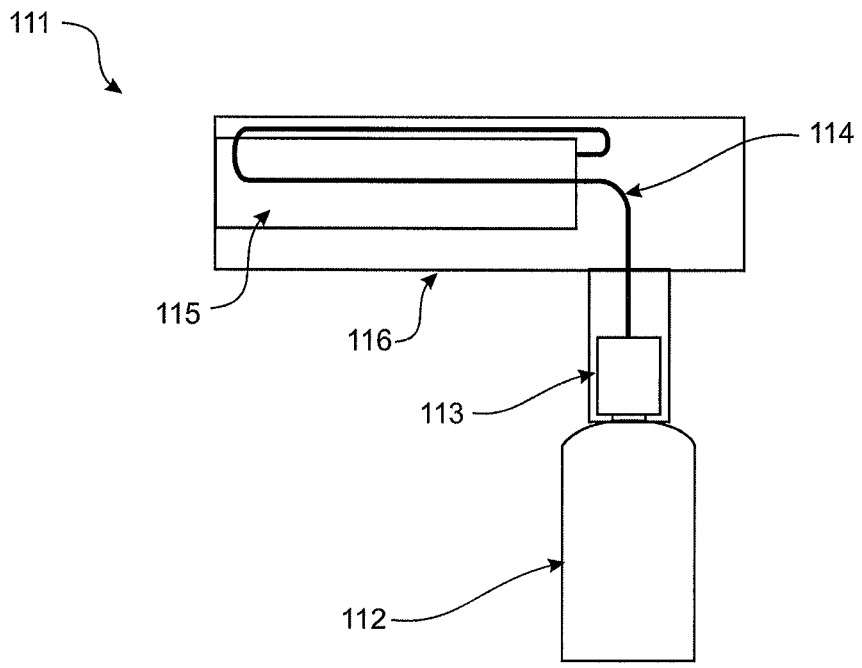
FIG. 4 illustrates the vaporisation system of the present invention according to a preferred embodiment.
Figure 5:
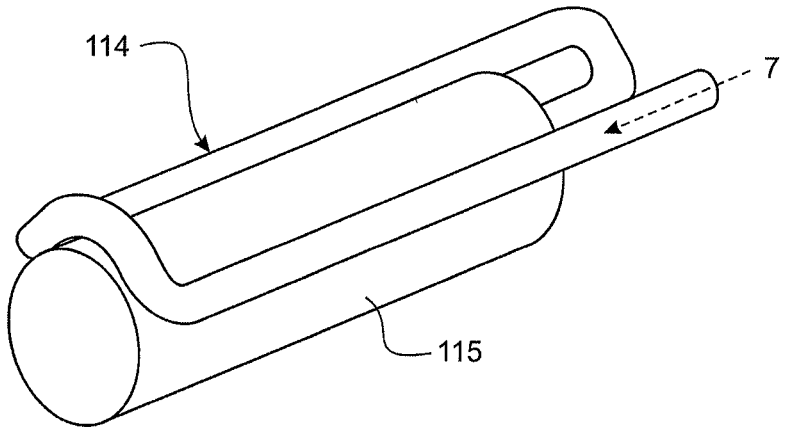
FIG. 5 illustrates the conduit of the vaporisation system of the present invention according to a preferred embodiment.

As illustrated in FIGS. 4 and 5, the nail gun (111) includes a main body (116), surrounding the operating mechanism (115). The main body (106) is formed of material having good heat conductive properties as well as having strength and weight properties conducive to a hand held tool such as the nail gun.

The conduit (114) is positioned such that the substantial length of the conduit (114) is encased by or integrated into the main body (116) adjacent the operating mechanism (115).

Heat absorbed by the main body (116) from the surrounding environment and the operating mechanism (115) is transferred to the conduit (114). The carbon dioxide within the conduit (114) is heated, and complete vaporisation is achieved before supply to the operating mechanism (115).

FIG. 5 illustrates positioning of the substantial length of the conduit (4) in relation to the operating mechanism (115).

The conduit (114) runs alongside the operating mechanism (115), encased by or integrated into the main body (not illustrated), before looping back along the other side of the operating mechanism (115). This means the conduit (114) is exposed to the greatest mass of the main body containing heat.

As partially vaporised carbon dioxide flows through the conduit (114) from the high pressure source (not illustrated) in the direction indicated by arrow (117), heat is absorbed. Because the path of the conduit (114) does not cross back through areas of the main body (116) from which heat has already been transferred, efficient use of ambient heat in vaporising the carbon dioxide is achieved.

On entry to the operating mechanism (115) the carbon dioxide is completely vaporised, and of a temperature less likely to cause the nail gun to malfunction or become damaged.

Figure 6:
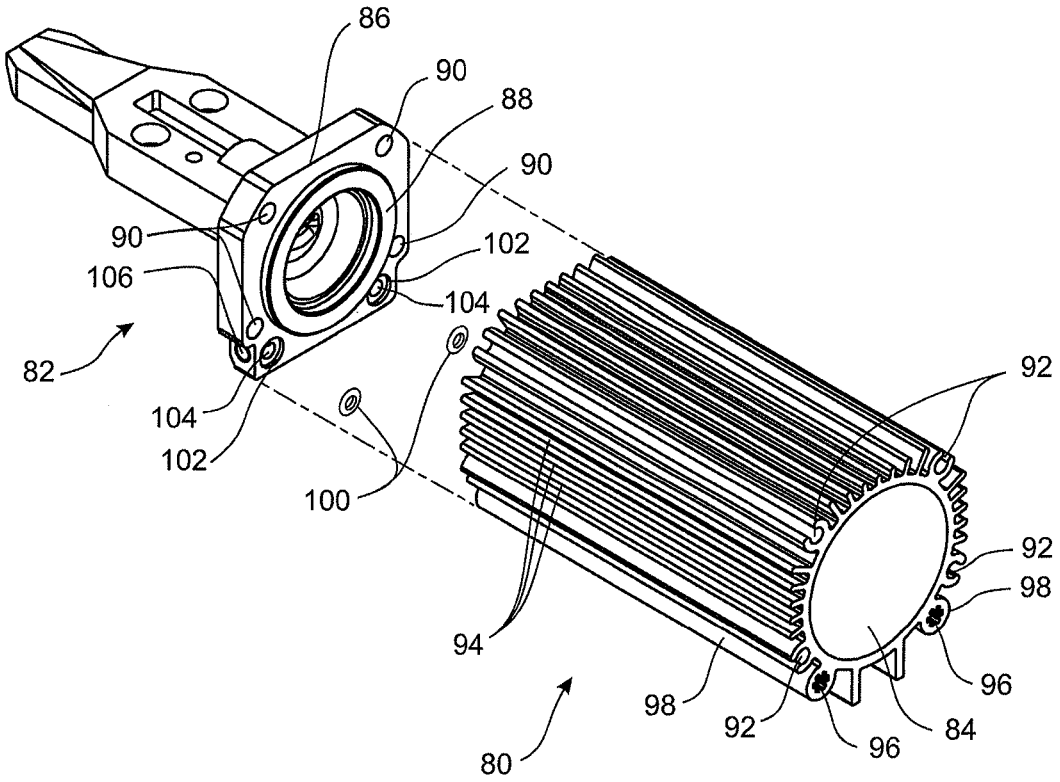
FIG. 6 is an exploded view of two components of a nail gun illustrating a preferred implementation of the present invention where the conduit is incorporated in the body of the device.

FIG. 6 is an exploded view of two components of a tool incorporating a preferred form of the present invention. The particular tool illustrated is in relation to the nail gun but the illustration is only to exemplify how the conduit can be incorporated into the body of the tool.

In this tool, the operating mechanism is enclosed in a barrel. An inner surface (84) of the barrel encloses the mechanism. The barrel is formed from a first component (80) providing an axial space and a second component (82) providing an end closure to the axial space.

In the preferred form the first component is formed as an extrusion, for example of an aluminium based material. In the preferred form, the second component is an end cap. The end cap (82) includes a flange (86) for securing to the end of the extrusion (80). A collar (88) projects from the face of the end cap (82) to fit within the open end of the axial space of the extrusion (80).

The flange (86) includes holes (90) for fasteners to pass through. Fasteners passing through the holes (90) can be secured in the ends of fastener channels (92) formed in the extrusion.

The extrusion (80) has heat dissipating fins (94) distributed around its perimeter.

Fastener channels (92) may each be provided as a pair of adjacent fins arranged with concave adjacent faces to provide a substantially cylindrical space for receiving a fastener, for example in the form of a screw.

The extrusion includes at least a pair of conduit portions (96). The conduit portions (96) are the longitudinally extending internal passages of hollow ribs (98) provided on the extrusion (80).

The end cap (82) includes a channel for passing the fluid from the forward end of one of the conduit portions (96) to the forward end of the other conduit portion (96).

The end cap may be constructed as a casting and the channel formed by subsequent machining steps. In the illustrated form, the channel is enclosed within the flange of the end cap, but could alternatively be formed on the face of the end cap and closed along the length of the channel by an end surface of the end face of the extrusion.

In the illustrated form, the channel includes channel openings (104), one of which will act as the channel entrance and the other as the channel exit. The channel openings (104) lead to a cross hole (106) which spans between the channel entrances. This may typically be formed as a hole through from the edge of the flange and plugged at its open end or ends. In FIG. 4, the reference (106) is applied to the plugged end of the cross hole.

Each opening (104) is surrounded by a seat (102) for receiving a seal, for example, in the form of O-ring (100). The seat (102) is in the form of a recess. Alternative seats and seals may be provided. For example, the seat may be a projecting lip for locating the O-ring (100), or the recessed seat may be provided on the end face of the extrusion (80) as well as or instead of on the face of the end cap (82).

When assembled, the conduit extends through a first conduit portion (96) through the channel of the end cap (82) and then back through the other conduit portion (96). Thus the conduit runs twice the length of the barrel and across the width of the end cap, all in intimate heat transfer relationship with the operating mechanism contained within the barrel.

Figure 7:
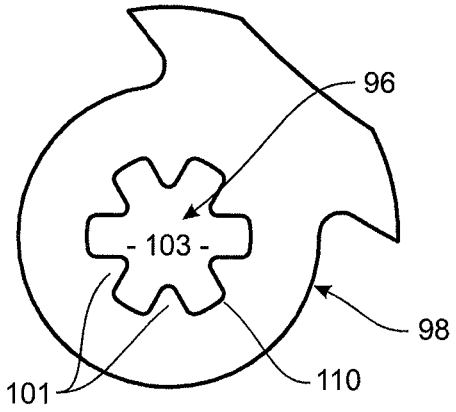
FIG. 7 illustrates a preferred cross section of the conduit.

FIG. 7 illustrates in greater detail a preferred feature of the conduit portions (96). According to this detail, each of the conduit portions (96) includes one or more projecting fins (101) extending from the inward surface. These fins (101) enlarge the contact area for the fluid passing through the conduit portion. For example, in the illustrated embodiment, the surface area for contact with the fluid passing through the conduit is substantially increased compared to a path of similar diameter but circular cross section and the cross sectional area (103) is substantially reduced compared to a path of similar diameter but circular cross section. As an indication, the ratio of the square of the perimeter (110) to the area (103) is in the order of 30. The similar ratio in relation to a conduit of circular cross section is approximately 12.5, and of square cross section is approximately 16.

Reference to a high pressure source should be understood to mean any way in which pressurised fluid is stored. For example, it is envisaged that the high pressure source is a canister configured to store the pressurised fluid at a pressure in the order of 750 psi. It should be appreciated that this is not intended to be limiting, and the pressure at which the fluid is stored may vary according to the application or ambient temperature of the high pressure source.

Reference to a regulator should be understood to mean any device known to one skilled in the art for controllably altering the flow of fluid through the device, particularly with regard to the pressure created by the flow of fluid. In particular, the regulator produces a differential pressure between the high pressure source and the conduit. It is envisaged that the pressure created on the conduit side of the regulator will be in the order of substantially 450 psi.

At 450 psi, carbon dioxide vaporises at approximately −5° C., whereas at 600 psi it vaporises at 6° C. Table 1 illustrates the transition point at which carbon dioxide vaporises in degrees Celsius for a range of operating pressures.

TABLE 1

Transition points for carbon dioxide between liquid and gaseous phases

| Pressure (psi) | Temperature (° C.) |
|---|---|
| 305 | −17 |
| 360 | −12 |
| 421 | −6 |
| 490 | −1 |
| 567 | 4 |
| 653 | 10 |
| 748 | 15 |
| 853 | 21 |
| 986 | 26 |
| 1069 | 31 |

The selection of the operating pressure in the conduit assists vaporisation of the fluid, even at lower operating temperatures.

This change in pressure causes the fluid to at least partially vaporise. However, at least a portion of the fluid will either not have been vaporised or will condense back into the liquid phase if no further action is taken.

The regulator sets conditions that are suitable for vaporisation at the ambient temperature. But vaporisation requires heat input equal to the latent heat of vaporisation. In the absence of sufficient heat input to the fluid, the vaporising fluid draws heat from the liquid. Accordingly the temperature of the liquid drops as more fluid vaporises until the liquid temperature reaches the transition temperature for the fluid at the lower pressure.

If the heating isn't sufficient to vaporise all of the liquid at the mass flow rate at which the tool is operating, liquid will remain at the transition temperature on the low pressure side of the regulator and may reach the operating mechanism with the tool inverted.

By locating the vaporisation system along the body of the tool in close thermal communication with the working mechanism and the ambient environment, and providing sufficient length of conduit, more heat is available to vaporise the liquid. The mass flow rate is a result of the firing rate of the tool. The firing rate of the tool directly influences the amount of heat generated in the working mechanism. As the mass flow rate increases so does the heat available to vaporise the fluid. The tool is therefore improved for use at higher mass flow rates without requiring an additional active heat source.

Reference to a conduit should be understood to mean any passage by which fluid may be conveyed to the operating mechanism of the motion transfer device.

In a preferred embodiment, the conduit is fabricated from thermally conductive material. It is envisaged that the body or casing of the motion transfer device will also be formed of a similar material. This provides efficient transfer of heat from the motion transfer device to the fluid in the conduit. The material may be aluminium, which has good heat conductive, strength and weight properties for application to the present invention. It should be appreciated that this is not intended to be limiting, and the conduit may be made of any material known to one skilled in the art to be useful for the conduction of heat.

Effectively, the conduit containing the fluid acts as a heat sink for the motion transfer device—transferring heat from the surrounding environment and heat generated during operation of the motion transfer to the fluid contained within the conduit.

This heating facilitates vaporisation of the fluid within the conduit before being supplied to the operating mechanism of the motion transfer device.

Positioning the conduit such that its length is substantially encased by or integrated into the motion transfer device adjacent to the operating mechanism exposes the conduit to the largest natural heat sources of the motion transfer device.

Reference to equalising flow pathways in the divider of the dose chamber annex (40) should be understood to refer to any manner in which fluid may transfer between the two spaces of the pressurised chamber.

In a preferred embodiment, the flow pathways are formed by the selection of thread pitch between the divider and the chamber such that fluid may flow between the two spaces. However, this should not be seen to be limiting as the equalising flow pathways may be formed by ports within the body of the divider, or entirely separate flow pathways formed in the body of the chamber itself.

It should be appreciated that this is not intended to be limiting, and that translation of the divider within the chamber may be achieved in any number of ways known to those skilled in the art. By way of example, the divider may be moved by application of axial force and have a separate locking mechanism to hold it in place within the chamber.

Alternatively, the rod may be threaded and engage a corresponding threaded portion of the pressure chamber. As the turning knob is rotated, the rod and the attached divider may be translated.

In a further alternative, the divider may internally threaded at its connection to the rod, the rod being configured to be capable of rotation about its axis, but in a fixed position within the chamber. As the turning knob and rod are rotated, the divider may be translated within the chamber along the width of the rod.

In a pneumatic tool such a nail gun, the pressure chamber may be utilised to contain a specific volume of pressurised gas to be used in the next cycle or shot of the tool. The volume of gas within the chamber corresponds to the resulting force or impact of the tool. Essentially, with reference to a nail gun the larger the volume of the chamber, the greater the force applied to the nail will be.

It should be appreciated that the pressure level of the chamber is maintained throughout adjustment, to ensure consistent operation of the tool.

Where the dimensions of the nail or specifications of the working material require less force, adjustment of the pressurised chamber facilitates this. As a result, the most efficient use of gas for the job at hand is achieved.

Aspects of the present invention have been described by way of example only and it should be appreciated that modifications and additions may be made thereto without departing from the scope thereof.

The invention claimed is:

1. An actuation system for a pneumatic machine, comprising:

a dose chamber including an inlet for high pressure fluid;

a working chamber extending away from the dose chamber, including a piston therein;

an annular wall separating a portion of the working chamber from the dose chamber such that the dose chamber partially surrounds the portion of the working chamber, wherein the annular wall comprises an annular valve member, said annular valve member having an outer ring portion and an interior portion, in which there is at least one opening extending completely through said interior portion, said annular valve member being movable relative to said working chamber between an open condition where said high pressure fluid in the dose chamber flows from the dose chamber, through a pathway which comprises said at least one opening of the annular valve member, and to the working chamber, and a sealed condition wherein said valve member closes said pathway, and in use the piston to be driven along the working chamber being at least partially within the surrounded portion of the working chamber with the piston at one end of its travel in the working chamber; and a valve actuator to selectively allow high pressure fluid from the dose chamber to flow into the working chamber, and operable to move the valve member to the unsealed condition.

2. The actuation system as claimed in claim 1 wherein an inlet flow path to the dose chamber is not closed when the valve member is open, but has greater flow resistance than the outlet to the working chamber.

3. The actuation system as claimed in claim 1, further comprising: a dose valve hammer releasable from a first position to strike the valve member and unseat the valve member to the open condition.

4. The actuation system as claimed in claim 1 wherein a head portion of the piston extends into the surrounded portion of the working chamber with the piston at one end of its travel in the working chamber.

5. The actuation system as claimed in claim 4 wherein the piston includes a head portion extending toward the inlet of the working chamber;

the cross sectional area of the piston head portion gradually decreasing toward the inlet end of the working chamber, the inlet region of the working chamber having a shape complementing the shape of the piston head portion.

6. The actuation system as claimed in claim 1, further comprising: an annex from the dose chamber, with a movable divider in the annex dividing the annex into a first portion and a second portion, and a divider position adjuster allowing adjustment of the position of the movable divider such that movement of the divider expands one portion of the annex at the expense of the other.

7. The actuation system as claimed in claim 6, further comprising: a restricted fluid path between the first portion of the annex and the second portion of the annex.

8. The actuation system as claimed in claim 1, further comprising: a conduit having a first end connected to, or adapted to be connected to, a regulator, and a second end for supplying gas to the dose chamber, the conduit having an extended path including a length adjacent the working chamber of the actuation system.

9. The actuation system as claimed in claim 1, wherein: as the piston moves through its travel, said high pressure fluid flow travels substantially though said at least one opening of the annular valve member into said working chamber, and not around an outer edge surface of said annular valve member.

10. The actuation system as claimed in claim 1, wherein the annular valve member defines an inner wall of said dose chamber.

11. The actuation system as claimed in claim 1, wherein the annular valve member defines at least part of an inner wall of said dose chamber.

* * * * *